United States Patent [19]

Kerls

[11] Patent Number: 4,485,426

[45] Date of Patent: Nov. 27, 1984

[54] SECURITY GARMENT

[76] Inventor: Edward E. Kerls, 1203 Dewberry La., Edna, Tex. 77957

[21] Appl. No.: 566,671

[22] Filed: Dec. 29, 1983

[51] Int. Cl.[3] ..... F41B 15/04

[52] U.S. Cl. ..... 361/232; 273/84 ES

[58] Field of Search ..... 361/232; 231/2 E; 272/27 N; 273/84 ES; 119/145

[56] References Cited

U.S. PATENT DOCUMENTS

| | | | |
|---|---|---|---|
| 1,046,985 | 12/1912 | Creedon | 361/232 |
| 1,915,721 | 6/1933 | Diaz | 361/232 |
| 2,155,331 | 4/1939 | Sadloski | 361/232 X |
| 3,211,153 | 10/1965 | Gambetti | 361/232 X |
| 4,006,390 | 2/1977 | Levine | 361/232 |
| 4,162,515 | 7/1979 | Henderson et al. | 361/232 |
| 4,242,715 | 12/1980 | Laird | 361/232 |
| 4,370,696 | 1/1983 | Darrell | 361/232 |

*Primary Examiner*—Reinhard J. Eisenzopf

*Attorney, Agent, or Firm*—Robert W. B. Dickerson

[57] ABSTRACT

A security garment which includes at least a pair of contact points, an electric circuit for generating a voltage differential between the pair of contact points, and a contact mechanism for causing a hostile person's body to close the circuit between the pair of contact points while insulating the user's person therefrom.

7 Claims, 7 Drawing Figures

SECURITY GARMENT

BACKGROUND OF THE INVENTION

One of the sad facts of modern American life is that there is danger in the streets. The number of crimes committed against the person, especially in congested urban areas, seems constantly on the rise. Enormous investments in personal security have been made both by industry and by individual or family units. A number of technological developments have been made, designed to afford protection to an individual when he or she may be accosted by a hostile person. One such development utilized an electric shock or charge being applied to such a hostile person by means of a device carried by a user. A search performed on this subject produced the following United States Patents, namely U.S. Pat. Nos. 1,046,985; 1,915,721; 4,006,390; 4,120,305; 4,162,515; 4,242,715; 4,337,496; and 4,370,696. Applicant's invention substantially improves over the prior art by (a) having utility in one or more environments, (b) being economical to fabricate, (c) being capable of using lightweight, electronic components, and (d) providing novel means for administering the charge to the hostile person.

SUMMARY OF THE INVENTION

An electrical or electronic circuit is provided for the purpose of generating a voltage differential between a plurality of contact points. These contact points are positioned at discrete points within a garment, such as a glove or jacket. A contact mechanism is also provided, in conjunction with said contact points, for assuring an electrical connection between said contact points and the surface of a hostile person's body. Said body surface serves to close the circuit, resulting in a disabling shock to such person.

DESCRIPTION OF PREFERRED EMBODIMENTS

Figure 2:
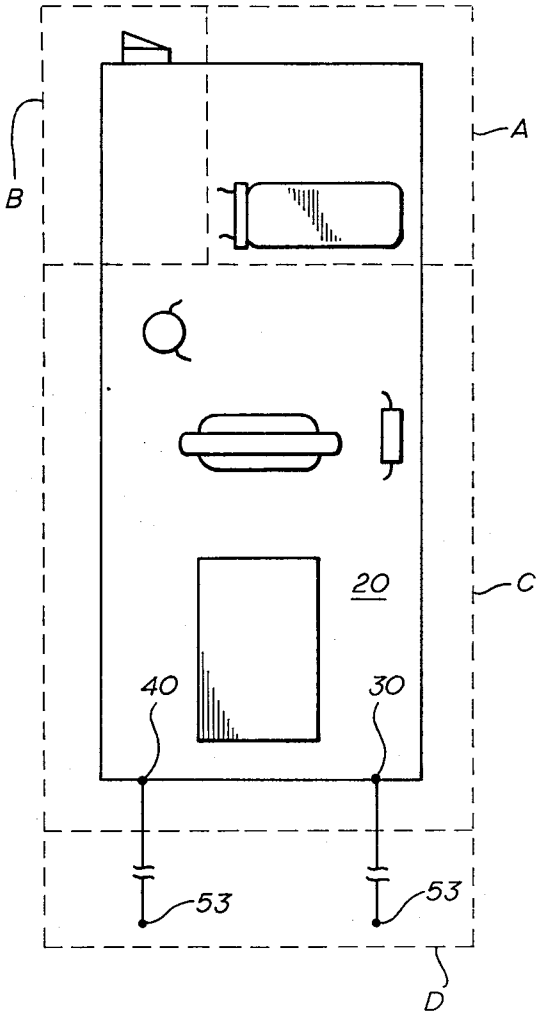
FIG. 2 is a, partly schematic, plan view of the circuitry of FIG. 1, as may be miniaturized on a bread board.
Figure 1:
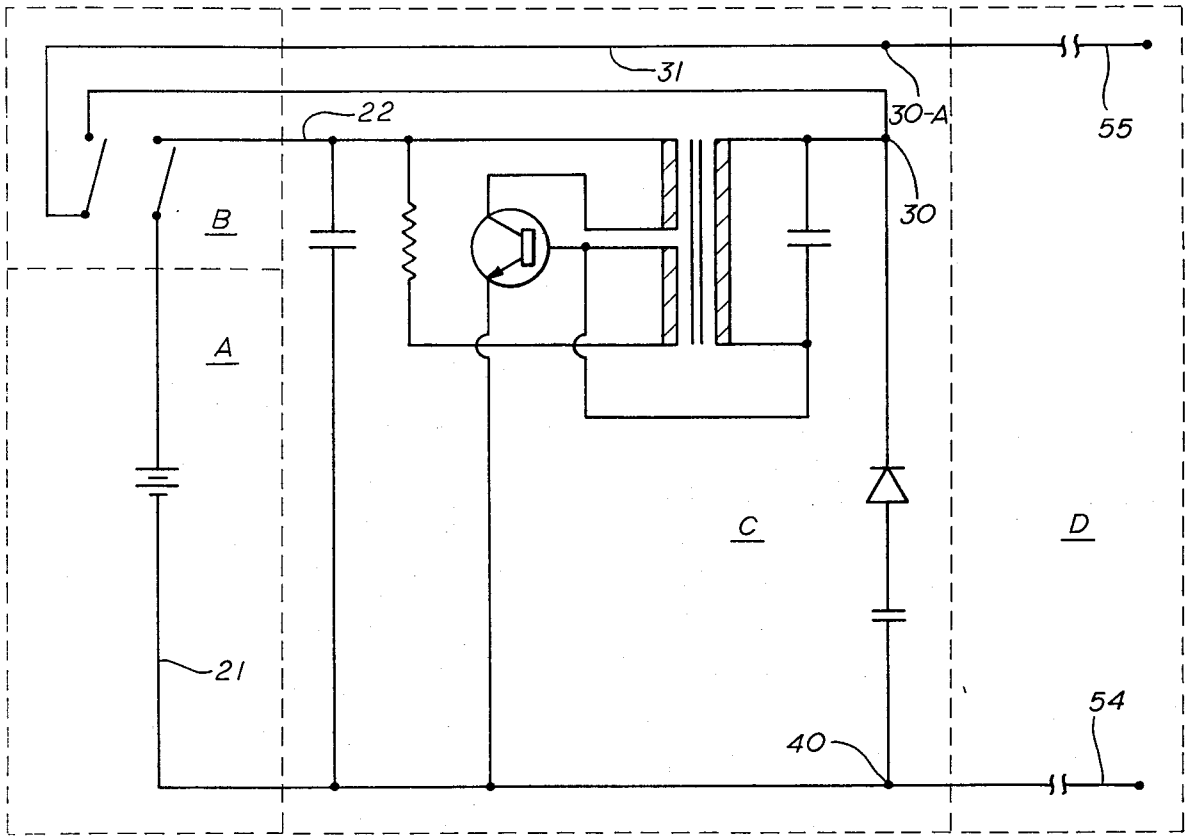
FIG. 1 is a schematic of a circuit adapted to produce a voltage differential across a pair of contact points.

The electrical circuitry, similar in all embodiments, is shown schematically in FIG. 1, and pictorially in FIG. 2. Attached to bread board 20, substantially enlarged in FIG. 2, would be the circuitry. Such circuitry comprises three principal components, each being illustrated within phantom lines. These components are the power source or battery A, double-throw, double pole switch B, voltage build-up C, and contact mechanism D. The particular circuit, or components, of Section C is subject to numerous modifications and, as particularly shown is not critical to this invention. Its prime purpose is to take the electrical potential of the battery in section A, perhaps 2–5 volts, and substantially step up the voltage differential across contact points 30, 40. To accomplish this, the battery of section A is conductively linked to said point 40 by lead 21, and to point 30 via the right hand throw of the switch of section B and lead 22, and thence to the left hand throw of the switch to lead 31 and to point 30-A. The individual elements of section C are generally connected between leads 21 and 22, ie., shunted across the battery.

Figure 3:
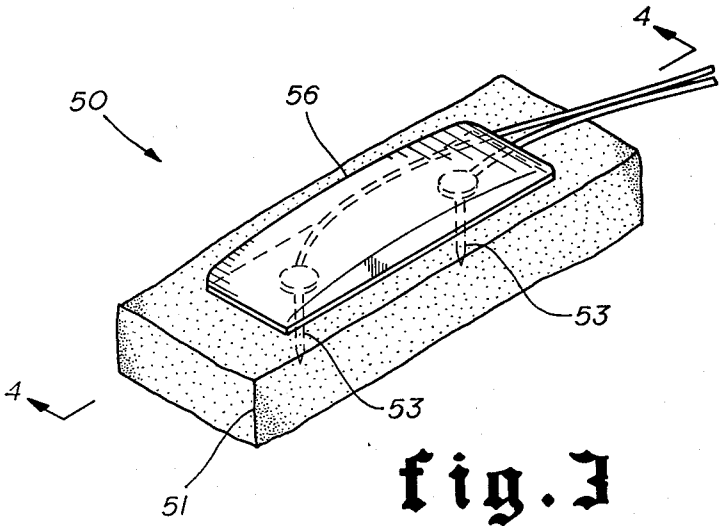
FIG. 3 is a perspective of the contact mechanism.
Figure 4:
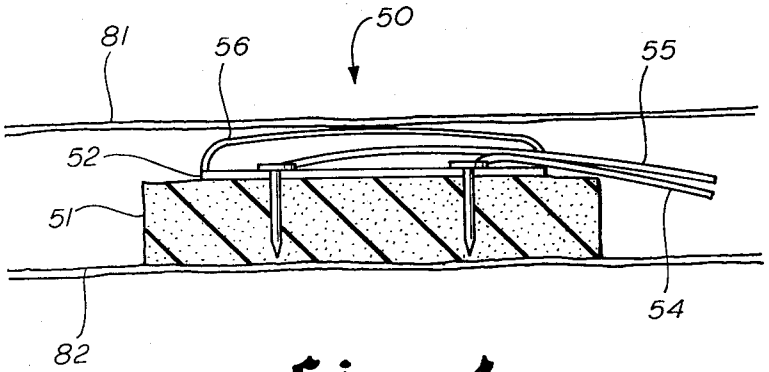
FIG. 4 is an axial section through the contact mechanism of FIG. 3, taken along lines 4-4, with the contact mechanism positioned between the inner and outer layers or lining of a garment.

Consider now the contact mechanism 50 specifically illustrated in FIGS. 3 and 4. A yieldable pad 51, preferably made of foam rubber has a relatively rigid backing member 52 positioned on one side thereof. Member 52, in turn, carries electrically conductive contact members, preferably pins, 53. The heads of pins 53 are connected by electrical leads 54, 55 to contact points 30-A, 40 respectively. The heads of pins 53 would be covered by an insulating layer of material 56.

Figure 5:
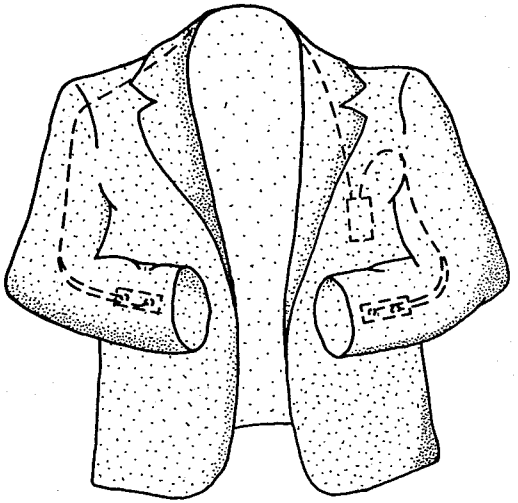
FIG. 5 is a front plan of a jacket having the voltage generating and contact mechanism positioned therein, the latter items being shown in phantom lines.
Figure 7:
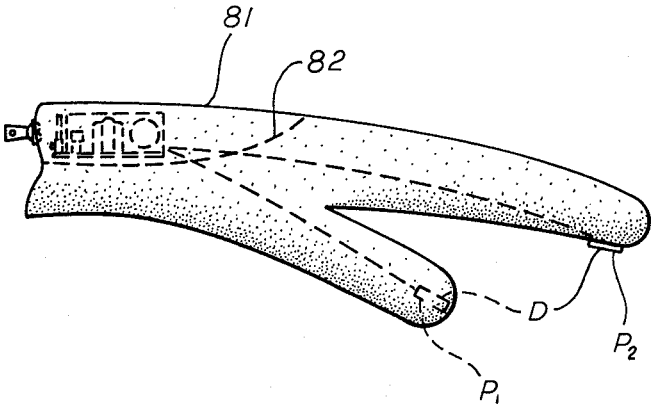
FIGS. 6 and 7 are top plan and end views, respectively of the voltage generating and contact mechanisms positioned within a glove, the outer layer of material being broken away in FIG. 6.
Figure 6:
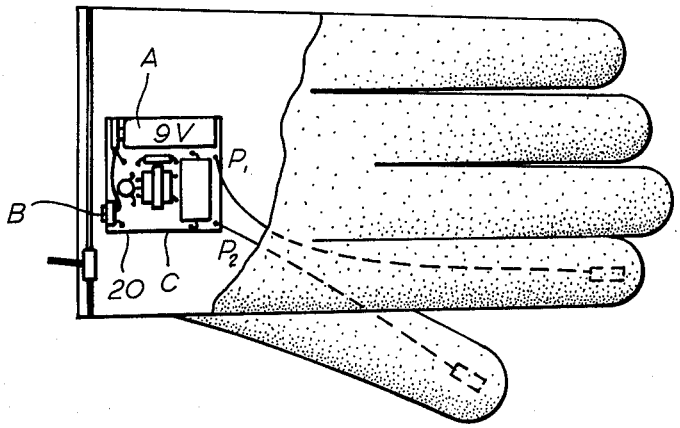

To permit use, the entire assembly may be positioned within a garment, in a number of different manners. For example, the circuitry elements of A, B and C of FIGS. 1 and 2 may be fixedly positioned intermediate adjacent layers 81, 82 of a garment, such as on the back of a glove, in the lining, as shown in FIGS. 6 and 7 or in the pocket of a jacket, as depicted in FIG. 5. Electrical conduits 54, 55 from contact points 30, 40 lead to contact pins 53 in contact mechanism D (in FIGS. 1 and 2). The contact mechanism may be positioned in the sleeve or elbow of a jacket (see FIG. 5), or the pins 53 may be separated and placed in separate digital members of a glove, as shown in FIGS. 6 and 7. Leads 54, 55 may easily be sewn or fabricated into the lining of the garment. In jackets, a contact mechanism 50 may be positioned in each sleeve, with leads 54, 55 going to each such mechanism from contact points 30, 40. Removable plugs may be inserted within leads 54, 55, permitting the components of sections A, B and C to be removed prior to cleaning a garment. In short, numerous modifications would be possible by one skilled in the art without departing from the spirit of the invention, the scope of which is limited only by the following claims.

I claim:

1. A device for administering an electric shock, said device comprising:

garment means;

means for providing a voltage differential between spaced locations of said garment means; and contact means for electrically contacting said garment means' spaced locations via spaced locations of a being's body, whereby said body is rendered adapted to close an electrical circuit which includes said voltage differential providing means, said contact means comprising, (a) a pair of spaced pin members each having a puncture point, said pin members each being substantially encased within a flexible pad, wherein said puncture points are adapted to exit said pad and contact said body.

2. The device of claim 1 wherein said garment means comprises a glove.

3. The device of claim 2 wherein said voltage differential providing means is positioned in the lining of said glove and said contact means is positioned in at least one digital portion of said glove.

4. The device of claim 2 wherein said voltage differential providing means is positioned in the lining of said glove and said contact means is provided in each of the thumb and one finger portion of said glove.

5. The device of claim 1 wherein said garment means comprises a jacket.

6. The device of claim 5 wherein said voltage differential providing means is positioned in a torso portion of said jacket and said contact means is positioned in at least one sleeve portion of said jacket.

7. The device of claim 5 wherein said voltage differential providing means is positioned in a torso portion of said jacket and said contact means is positioned in both sleeve portions contained in said jacket.

* * * * *